United States Patent [19]

Hagen et al.

[11] 4,086,036

[45] Apr. 25, 1978

[54] DIAPHRAGM PUMP

[75] Inventors: Loren M. Hagen, Chicago; Ashwin H. Desai, Arlington Heights, both of Ill.

[73] Assignee: Cole-Parmer Instrument Company, Chicago, Ill.

[21] Appl. No.: 686,659

[22] Filed: May 17, 1976

[51] Int. Cl.[2] ..... F04B 43/04

[52] U.S. Cl. ..... 417/413; 417/437; 92/99; 417/566

[58] Field of Search ..... 415/214; 417/413, 414, 417/395, 479, 480, 383, 470, 471; 92/97, 99

[56] References Cited

U.S. PATENT DOCUMENTS

| | | | |
|---|---|---|---|
| 2,711,134 | 6/1955 | Hughes | 417/395 |
| 2,742,785 | 4/1952 | St. Clair | 92/99 |
| 3,021,792 | 2/1962 | Johnson et al. | 92/99 |
| 3,415,198 | 12/1968 | Lappo | 417/542 |
| 3,461,808 | 8/1969 | Nelson et al. | 417/479 |
| 3,900,276 | 8/1975 | Dilworth | 417/542 |
| 3,936,245 | 2/1976 | Hilgert | 417/566 |
| 3,947,156 | 3/1976 | Becker | 92/99 |
| 3,999,899 | 12/1976 | Sakai et al. | 417/566 |

FOREIGN PATENT DOCUMENTS

| | | | |
|---|---|---|---|
| 937,214 | 5/1948 | France | 417/395 |
| 1,197,226 | 7/1970 | United Kingdom | 417/566 |

*Primary Examiner*—C. J. Husar

*Attorney, Agent, or Firm*—Fitch, Even, Tabin and Luedeka

[57] ABSTRACT

A flexible diaphragm having an arcuate ridge defines the pumping chamber of a fluid pump and is reciprocated by connection to the output shaft of an electric motor. The rigid plate portion of a connector is joined to the central portion of the diaphragm while the remainder thereof extends in an opposite direction where it is linked with an eccentric coupling carried by the output shaft of the motor. Although the diaphragm is driven in a rocking, reciprocating movement, the housing is formed with surface support portions which have radii of curvature such as to support the diaphragm during its distended periods, thereby assuring a long lifetime of diaphragm operation. The overall arrangement results in improved efficiency in pumping gases as well as liquids.

13 Claims, 6 Drawing Figures

Fig. 1.
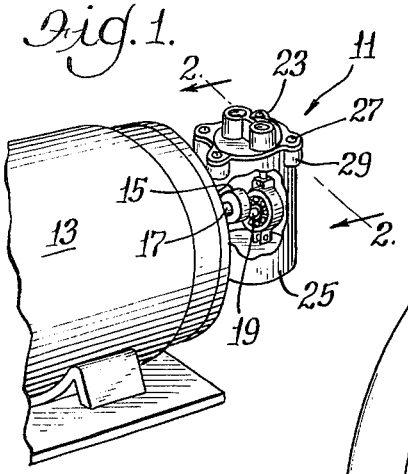
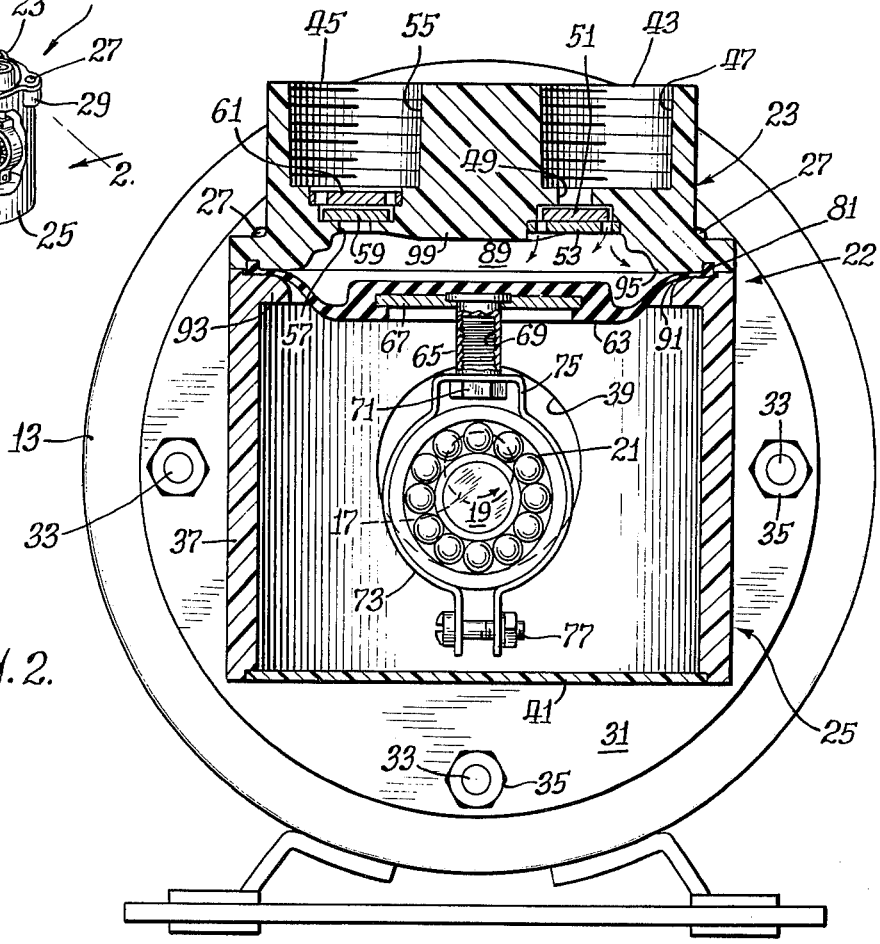
Fig. 2.
Fig. 3.
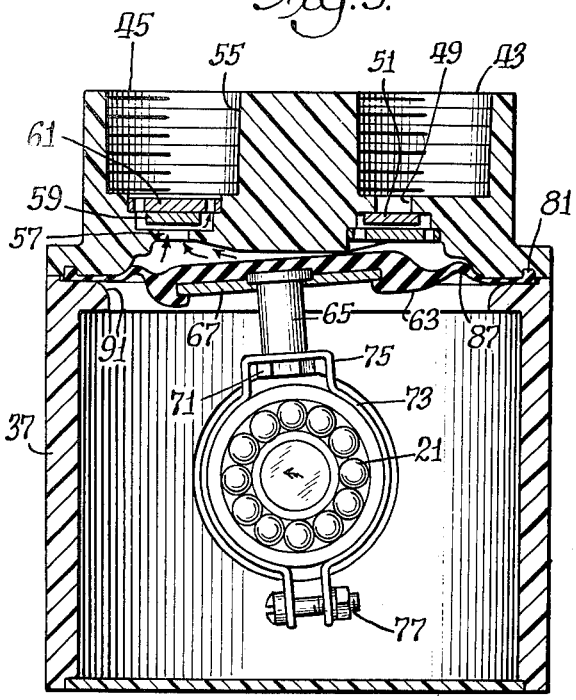
Fig. 4.
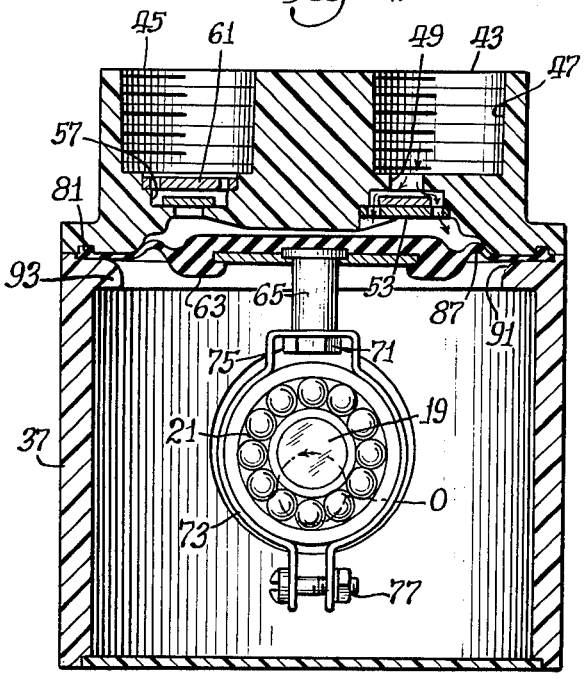

DIAPHRAGM PUMP

This invention relates to fluid pumps and more particularly to flexible diaphragm pumps which will efficiently pump either liquids or gases.

Flexible diaphragm pumps have been in use for numerous years and have been fairly widely used for simple liquid pumping operations. Generally, a pumping chamber of variable volume is defined in part by a flexible diaphragm, usually circular, which is suitably clamped around its circumference. Valves of simple design are provided in an inlet and an outlet leading to the pumping chamber, and pumping action is achieved by the reciprocation of the diaphragm so as to alternately increase and then decrease the volume of the pumping chamber. On the suction stroke, fluid is drawn in through the inlet valve while the outlet valve remains closed. Thereafter, on the discharge stroke, the intake valve closes, and the fluid is discharged through the outlet valve.

U.S. Pat. No. 3,461,808 shows a liquid pump of this type wherein a handle is provided for manual actuation of the diaphragm. U.S. Pat. No. 3,273,505 shows a fuel pump of this type which utilizes an electromagnet to drive the diaphragm on one stroke and a spring to drive it on the return stroke. U.S. Pat. No. 2,711,134 is similar except that it substitutes a source of high-pressure liquid for the electromagnet to achieve the power stroke. U.S. Pat. No. 3,152,726 shows a pump of this general type which is driven from an electric motor via a linkage that includes a rotary cam which alternately lifts and then drops a roller attached to a plunger that reciprocates the diaphragm.

A major deficiency of diaphragm pumps of this type is the limited life of the flexible diaphragm because its failure renders the pump inoperative until replacement is effected. As a result, although pumps of this type have been used for pumping gases, e.g., to create a vacuum or superatmospheric air pressure, such pumps have not achieved truly satisfactory operation.

It is an object of the present invention to provide an improved diaphragm pump for the transfer of fluids. Another object of the invention is to provide a diaphragm pump adapted to be driven from the shaft of an electric motor which is simple in design but extremely effective in pumping characteristics. A further object of the invention is to provide a diaphragm pump of simple design which is capable of high speed operation and which has an improved diaphragm lifetime without sacrificing pumping characteristics. Still another object of the invention is to provide a diaphragm pump of simple construction which will create an effective vacuum when driven via a relatively inexpensive linkage from the output shaft of an electric motor.

These and other objects of the invention will be apparent from the following detailed description of a preferred embodiment of the fluid pump, when read in conjunction with the accompanying drawings wherein:

FIG. 1 is a perspective view showing a fluid pump embodying various features of the invention mounted upon an electric motor and operatively connected to the shaft thereof;

FIG. 2 is an enlarged vertical sectional view taken generally along the line 2—2 of FIG. 1, showing the diaphragm at the bottom of the suction stroke;

FIG. 3 is a view similar to FIG. 2 showing only the pump mechanism and illustrating the diaphragm where it has reached a point near the end of the discharge stroke;

FIG. 4 is a view similar to FIG. 3 showing the diaphragm just beginning the suction stroke;

Figure 5:
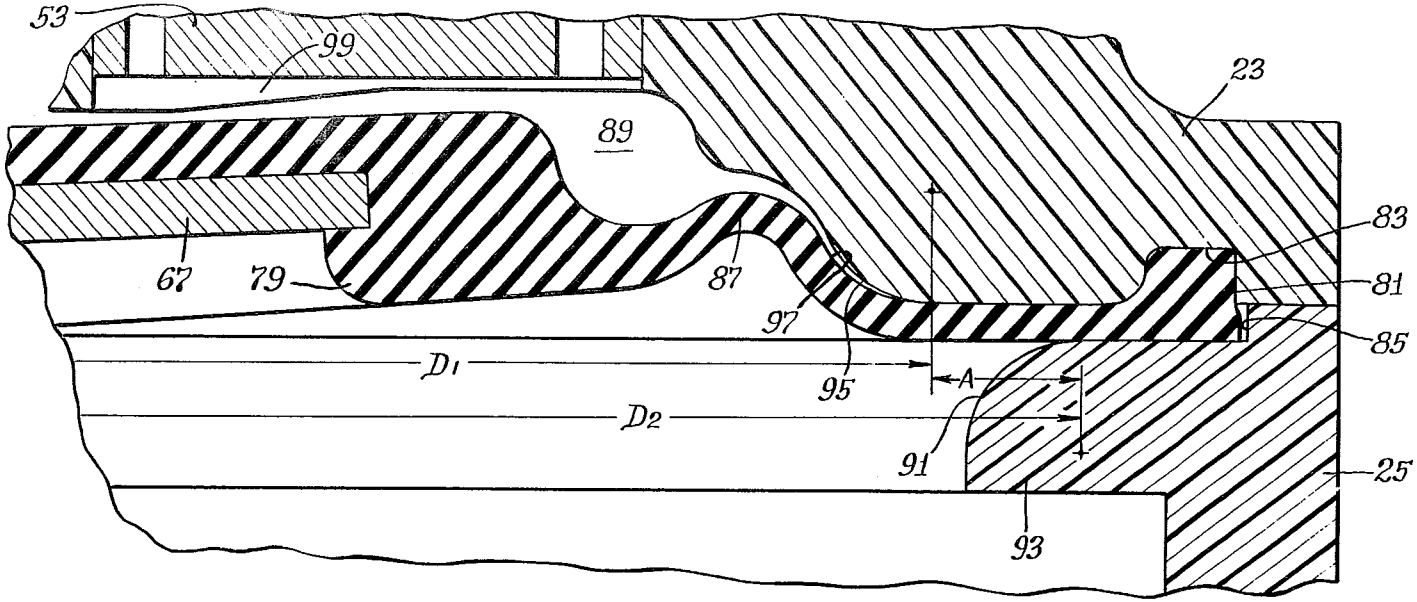
FIG. 5 is an enlarged fragmentary view showing a portion of the pump as depicted in FIG. 3.

It has been found that an increased lifetime and improved efficiency can be achieved in a diaphragm pump of this general type while utilizing the high speeds available from the output shaft of an electric motor. One of the simplest ways of translating the rotary motion available from an electric motor to reciprocating motion is to use an eccentric; however, without complicating the linkage, true straight-line reciprocating motion is not achieved because the resultant reciprocation inherently includes some rocking motion. It has been found that by appropriate design of the pump components, such rocking motion is tolerable in a diaphragm pump of this type, and that the combination of the diaphragm design plus the manner and location of mounting the diaphragm in the pump housing can be employed to achieve increased diaphragm lifetime, which has long been an aim in pumps of this type.

Shown in FIG. 1 is a pump 11 embodying various features of the invention mounted in operating position on an end of a standard electric motor 13. Although the motor itself forms no part of the present invention, the comparison afforded by FIG. 1 shows the relative smallness and compactness of the pump 11 compared to the usual size of a fractional horsepower AC electric motor. A coupling 15 is suitably mounted to the rotary shaft 17 of the electric motor 13, which coupling carries an eccentrically mounted stub shaft 19. The eccentric stub shaft 19 is received within the inner race of a ball bearing bushing 21 and traces a circular path or orbit (see FIG. 4, dot-dash line with reference letter "O") as the shaft 17 of the electric motor rotates about its axis.

As best seen in FIG. 2, the pump 11 includes a two-piece housing 22 made up of an upper head section 23 and a lower main body section 25. Although the terms "upper" and "lower" are used throughout this application for ease in describing the pump components with respect to the orientation in which they are depicted in the drawings, it should be understood that they are used only for illustrative purposes and that the pump 11 will function equally well regardless of its attitude, i.e., whether it is rotated at 90° or even 180° from the illustrated position.

The two sections 23,25 of the pump housing are preferably molded from a durable, corrosion-resistant plastic material, for example, Noryl, a polyphenylene oxide resin marketed by General Electric Company, although other suitable materials can be used. The head 23 is tightly joined to the top of the body section 25 of the housing by four screws 27. To assure good holding power for these screws, brass inserts (not shown) are preferably molded in four bosses 29 which are appropriately angularly spaced about the top of the body section 25. A circular mounting flange 31 is provided as an integral part of the housing body section 25, which flange has four holes through which threaded bolts 33 from the electric motor protrude and upon which nuts 35 are installed to complete the mounting. The body section 25 includes a hollow cylindrical casing 37 having a vertical axis which is integral with and extends forward from the mounting flange 31. An enlarged hole 39 allows motor shaft 17, the coupling 15 and some of the attached linkage to be inserted therethrough into the cylindrical casing 37. The lower end of the casing 37 is closed by an aluminum disc 41 or the like.

The head section 23 of the housing is molded to provide an inlet 43 and an outlet 45 for the pump. The inlet 43 includes an uppermost threaded hole 47 for receiving a threaded coupling for attachment to a fluid inlet line. Interconnecting this threaded hole 47 and the underside of the head 23 is a stepped passageway 49 having three different diameter sections. The uppermost smallest diameter section remains empty and provides an undersurface against which a valve member, a small circular disc 51, abuts to close the inlet 43 during the discharge stroke of the pump. The valve disc 51 is trapped in the intermediate passageway section by a rigid, apertured retainer 53 which is press-fit, or otherwise suitably secured, in the lowermost section of the passageway 49 which has the greatest diameter. The holes in the retainer 53 are elongated and are positioned so that it is impossible for the valve disc 51 to close the holes when the valve is open, as shown in FIG. 2, whereas the diameter of the disc is sufficient to assure that it will totally close the smallest diameter section of the passageway 49 during the discharge stroke.

To ensure maximum pump performance of flow, pressure and vacuum, two factors are particularly important for valve design. First, the valve member should seat properly on the valve seat and provide a proper seal, and second, the valve member should not unnecessarily stick to the valve seat but should precisely follow the diaphragm movement.

These factors become quite critical for an all plastic pump because, when two plastic materials are involved in relative motion against each other, a phenomenon called scuffing wear takes place. The relative motion creates pressure and frictional heat. Under these conditions, thermoplastics melt and develop a tendency to adhere or stick to the adjacent surface, i.e., plastic valve member to the plastic valve seat, which can result in a decrease in the total flow and the pressure or vacuum characteristics of the pump.

Such adhering of the adjacent surfaces is broken by shearing action which results in fine polymer powder being gradually removed from the surfaces. In turn, these particles weld to the valve seat, and eventually their build-up prevents proper seating of the valve member and sealing of the valve. It is found that use of plastic parts with lubricating and nonstick properties will minimize this problem. The parts may be coated with polytetrafluoroethylene or molybdenum disulphide or a like material. When the valve body is made from one thermoplastic material, it has been found that improved results are obtained by forming the valve members from a different thermoplastic material. In the present case, very satisfactory results are obtained by molding the head 23 from polyphenylene oxide and stamping the valve disc 51 from polytetrafluoroethylene.

The outlet 45 is similarly formed with an uppermost threaded section 55 and a stepped lower passageway 57 of three different diameter sections, with the smallest diameter section being that which connects with the underside of the head section 23 of the housing. A circular valve disc member 59 is again entrapped within the intermediate section by an apertured retainer 61 which is secured in the uppermost section, and the stepped passageway 57, the disc and the retainer together constitute the outlet valve.

Figure 6:
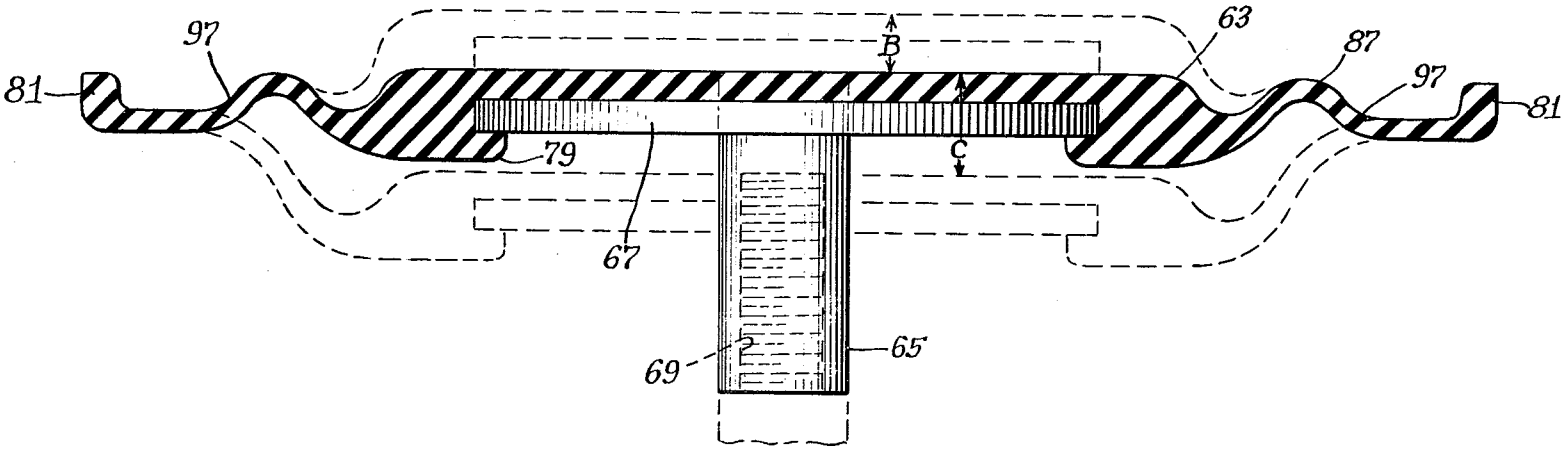
FIG. 6 is a sectional view taken through the center of the diaphragm subassembly showing the diaphragm, in full lines, in its unstressed condition and showing, in broken lines, the condition of the diaphragm at the very end of the discharge stroke and at the very end of the suction stroke.

The diaphragm assembly is shown by itself in FIG. 6 and comprises a flexible diaphragm 63 plus a reinforcing or center plate subassembly that includes a rigid post 65 which extends downward from the center of a rigid circular plate 67, formed of steel or the like. The post 65 is drilled, and the drilled hole is provided with internal threads 69 which receive mating threads on a bolt 71.

As previously indicated, the eccentric 19 on the motor shaft coupling 15 is press-fit within the inner race of the bushing 21, and a clamp 73 is fit about the outer race of the bushing. The clamp 73 is formed with an upper bracket portion 75 that contains an aperture through which the bolt 71 is inserted prior to the installation of the clamp about the outer race of the bushing 21, and the tightening of a screw and nut 77 effects the final joinder.

The flexible diaphragm 63 is made from a durable, preferably chemical-resistant, synthetic rubber or elastomer material, and it is preferably molded about the center plate 67 subassembly, which would be provided as an insert in the mold cavity using conventional molding techniques. For example, the flexible diaphragm 63 can be made from Nitrile or Viton synthetic elastomer. As a result of the molding process, the rear surface of the center of the flexible diaphragm 63 is in adherent contact with the upper surface of the rigid plate 67 and thus effectively transmits the force from the rotating shaft 17 to the diaphragm. The firm connection between the plate subassembly and the flexible diaphragm is enhanced by the total surrounding of the outer circumference of the plate 67 by the diaphragm 63 as a result of an inward-extending flange 79 which is created as a part of the molding process.

As earlier indicated, the diaphragm 63 is generally planar in configuration and is circular in outline. An upstanding bead 81 is molded at the very circumference of the diaphragm 63, which assures the tight entrapment of the entire periphery of the diaphragm between the mating sections 23,25 of the pump housing. As best seen in FIG. 5, the depth of a circular groove 83 cut in the undersurface of the head 23 is less than the height of the peripheral bead 81 but slightly greater in radial dimension, so that the bead is squeezed to cause it to fill the groove and bulge slightly outward into a pocket 85 provided in the upper surface of the housing body when the head is mated to the body 25. This arrangement of placing the bead 81 in vertical compression effectively clamps the flexible diaphragm 63 within the housing 22 without stressing the diaphragm in a radial direction, which would create stresses contributing to wear deterioration.

The flexible diaphragm 63 is formed with an upstanding arcuate convolution or ridge 87 which provides an important function in assuring a long lifetime for the diaphragm. The upper surface of the diaphragm 63, when clamped in position, together with the undersurface of the head section 23 of the housing defines the pumping chamber 89. With respect to the pumping chamber 89, the arcuate ridge 87 is convex. The remainder of the features of the construction of the diaphragm 63 and the housing 22 are most understandably explained with regard to the operation of the pump during its pumping cycle.

In FIG. 2, the pump 11 is shown with the diaphragm 63 in its lowermost position where it resides at the completion of the suction stroke, at which instant the pumping chamber is at its largest volume. In this position the eccentric 19 is at the lowermost point of its orbit and is in vertical alignment below the rotating motor shaft 17, which is shown in FIG. 2 in dotted lines. In this position, the diaphragm has flexed in the location of the arcuate ridge 87, and it can be seen that the arcuate ridge has substantially disappeared, having been blended into a relatively smooth curve. The dimensioning of the arcuate ridge 87 is such that substantially no stretching has occurred in the diaphragm; instead, there has merely been a straightening-out of the arcuate ridge section.

It is also noted that the outlet or discharge valve is still in the closed position with the valve disc 59 seated against the upper exit from the smallest section of the passageway and that the inlet valve remains in the open position, as it has been throughout this half of the cycle allowing the entry of fluid through the apertured retainer 53 and into the pumping chamber 89. As can be seen from FIG. 2, the diaphragm, which has been substantially displaced from its unstressed planar condition, extends downward from the clamped bead 81 at its perimeter and is supported by the curved surface 91 of inward extending flange 93 formed at the upper end of the cylindrical body casing 37 which is in the form of a section of the surface of an annulus.

As the eccentric 19 continues its counterclockwise travel along the circular orbit and the pumping stroke begins, the reinforcing plate 67 will rock downward and to the left, as viewed in FIG. 2, while the right-hand side begins to elevate. This further lowering or dipping of the left-hand edge of the central portion of the diaphragm 63 results in a further simultaneous flexing and straightening of the diaphragm in this region as the left-hand edge is dipping to its lowest point. During this time it is important that the smooth curvature of the flange 93 uniformly supports the diaphragm.

Counterclockwise travel of the eccentric 19 continues until the position shown in FIG. 3 is reached near the end of the pumping or discharge stroke, through which time the intake valve remains closed while the discharge valve member 59 is in the open position. At this point in the cycle, the eccentric 19 is nearing its vertical alignment with the shaft 17 of the electric motor and is illustrated in about the "1 o'clock" position wherein the right-hand edge of the central section of the diaphragm 63 is at about its highest vertical position and the left-hand edge of the central section of the diaphragm is at about its farthest displacement to the left. As a result, substantial flexing is taking place along both the right-hand and left-hand edge portions of the diaphragm 63 which are locations where greatest wear occurs.

It is important that the curvature of the supporting undersurfaces of the head 23 be matched to the curvature of the diaphragm 63 in these abutting regions in order to minimize flexing and wear during this critical period of the cycle. As best seen in FIG. 5, the underside of the housing head 23 is formed with an annular surface portion 95 having a radius of curvature that is substantially matched to the radius of curvature of the upper surface of the diaphragm in a region 97 at the radially outer edge of the arcuate ridge 87. Preferably, the radius of this annular surface section 95 is within 5 percent of the radius of curvature of the corresponding region 97 of the upper surface of the diaphragm.

As can be seen in FIG. 5, the curvature of the right-hand section of the upwardly distended diaphragm 63 fairly closely follows the curvature of the supporting undersurface portion 95 of the head. The length of actual contact between the two surfaces will depend upon the pressure in the pumping chamber 89 and will usually be longer at the beginning of the suction cycle depicted in FIG. 4. Minimizing the flexing which occurs in the diaphragm reduces stresses and heat build-up and increases its lifetime, and particularly important is the flexing of the arcuate ridge region when it is in its convex orientation as depicted in FIGS. 3 and 4. To assure a long lifetime for the diaphragm, it has also been found important to separate the region where wear will occur on the upper surface and from the wear region on the lower surface.

The separation of the wear regions is best illustrated in FIG. 5 wherein the diameter of the annular surface section 95 formed on the underside of the head 23 is labeled $D_1$, and the diameter of the annular surface portion 91 provided on the inwardly extending flange 93 of the body casing 37 is labeled $D_2$. As can be seen from FIG. 6, the thickness of the diaphragm 63 is substantially constant throughout the region of the arcuate ridge 87, through the flat section radially outward thereof, and substantially all the way to the transition into the upstanding circumferential bead 81. In order to effectively separate the wear regions, the difference in the diameters $D_1$ and $D_2$ should be equal to an amount at least four times the thickness of the diaphragm in this region and preferably at least six times the thickness. This difference is equal to twice the distance marked by the reference letter in FIG. 5. Stated in another way, the distance A which is the radial distance between the center points for the radii of curvature of the supporting surface portions of the upper and lower housing sections 23,25 should be equal to at least twice and preferably three times the thickness of this diaphragm region. As a result, the region where the greatest amount of wear occurs along the lower surface of the diaphragm 63 is effectively separated from the region where the greatest amount of wear occurs along the upper surface of the diaphragm, and thus the contributions of the wear to the ultimate failure of the membrane are not additive, resulting in a substantially longer membrane lifetime. Furthermore, the matching of the radius of curvature of the annular section 95 of the head to the corresponding curved region in the diaphragm translates the flexing of the diaphragm occurring at the left-hand region in FIG. 3 into a rolling action upward along the supporting surface, and likewise causes the diaphragm region to roll off the supporting arcuate surface during the early part of the suction stroke as depicted in FIG. 4, minimizing the bending stress which occurs at the upper surface of the membrane.

It has also been found that debilitating wear which contributes to the failure of a flexible, generally planar diaphragm of this type has a greater tendency to occur during the period when the diaphragm is distended in the direction in which it is convex, i.e., when it lies above its unstressed condition just before and after the end of the pumping stroke. Accordingly, it has been found that a longer lifetime is achieved if the diaphragm 63 is mounted within the pump housing 22 so that its position at the conclusion of the pumping or discharge stroke amounts to a substantially lesser displacement from the unstressed condition than does the position of the diaphragm at the end of the suction stroke. The total vertical displacement upward is indicated in FIG. 6 by the reference letter B, and the total vertical displacement downward is indicated by the reference letter C. Preferably, the distance C should equal at least about 1.5 times the distance B.

When pumping compressible fluids, particularly gases, the pumping efficiency is affected by the amount of dead volume remaining in the pumping chamber 89 at the conclusion of the pumping or discharge stroke. The illustrated pump 11 has been found to be extremely effective in pumping gases for the purpose of creating a vacuum or superatmospheric air pressure. One of the contributing factors to its good efficiency is the high speed which is obtainable from the rotating shaft of an electric motor using the illustrated linkage, so long as the diaphragm design is such that it has a reasonably long lifetime. Another contributing factor is the provision of a depending projection 99 in the undersurface of the head section 23 of the housing which is compatible with the rocking movement of the diaphragm and the effect of which is perhaps best seen in FIGS. 3 and 4. The projection 99 runs diametrically across the undersurface of the head in a direction perpendicular to the centerline upon which the inlet 43 and outlet 45 are located. The cross section of the projection 99 relative to what would otherwise be a flat central portion of the housing head is that of a trapezoid. The projection 99 significantly reduces the dead volume of the pumping chamber (shown in FIG. 4), and its trapezoidal shape provides clearance for the upper surface of the central portion of the diaphragm in its canted orientation depicted in FIG. 3.

In summary, although the diaphragm pump 11 provided by the invention is very simple in design and construction and small in size, it has proved to be efficient in pumping operation. The high speed operation available from an electric motor (e.g., 1550 r.p.m. for a 1/45 HP motor) renders it capable of transferring relatively large amounts of fluid (e.g., 900 cu. in. of air per min.) although the pumping chamber itself is relatively small in volume, capable of delivering air at about 20 psig and also capable of creating an excellent vacuum (e.g., 22 inches of Hg.). Moreover, the pump design renders it well suited for the transfer of liquids, and particularly corrosive chemicals, because the liquid being pumped need not contact any metal; of course, liquids would be pumped using a slower r.p.m.

Although the invention has been described with respect to a particular preferred embodiment, it should be understood that various modifications as would be obvious to one having the ordinary skill in the art may be made without departing from the scope of the invention which is defined solely by the appended claims. Various of the features of the invention are set forth in the claims which follow.

What is claimed is:

1. A fluid pump comprising a housing having an inlet for fluid, an outlet for fluid and a pumping chamber in communication with said inlet and outlet, inlet valve means, outlet valve means, a flexible diaphragm having an arcuate ridge formed therein, which diaphragm is clamped about its periphery between two separable sections of said housing and has one surface defining part of the boundary of said pumping chamber, said arcuate ridge being convex with respect to said pumping chamber, a connector extending from the central portion of the opposite surface of said diaphragm, means for attaching said housing to a rotary motor, and drive means for reciprocating said diaphragm to alternately draw fluid into the pumping chamber through said inlet valve means and then discharge the fluid through said outlet valve means, said drive means including an eccentric coupling for connection to the output shaft of the rotary motor plus linkage means joining said eccentric in driving relationship to said connector so that rotation of the motor shaft causes said diaphragm to be driven in a rocking, reciprocating movement, and one said housing section being formed with a curved surface portion which is a section of an annulus located on the pumping chamber side of said diaphragm and which has a radius of curvature such as to support said diaphragm during the period it is distended into the pumping chamber region and said other housing section being formed with a second curved surface portion which is a section of an annulus having a diameter substantially greater than the diameter of said first-mentioned annulus so that the regions of wear resulting from contact between each surface of said diaphragm and the respective supporting curved surface portions of said housing are radially spaced from each other.

2. A fluid pump in accordance with claim 1 wherein a projection is formed in the wall of said housing generally between said inlet and said outlet, which projection extends into the pumping chamber and decreases dead volume thereof.

3. A fluid pump in accordance with claim 2 wherein said projection extends diametrically across said pumping chamber and has a cross sectional shape of a trapezoid.

4. A fluid pump in accordance with claim 1 wherein the radii of curvature of said annuli are substantially equal.

5. A fluid pump in accordance with claim 1 wherein the thickness of said diaphragm in said convex arcuate ridge region is substantially constant.

6. A fluid pump in accordance with claim 1 wherein said diaphragm is clamped at a location within said housing so that it is displaced a substantially greater distance from its unstressed configuration at the completion of the suction stroke than it is displaced at the completion of the pumping stroke.

7. A fluid pump in accordance with claim 6 wherein said greater distance is at least 50 percent greater.

8. A fluid pump in accordance with claim 1 wherein the radius of curvature of the surface of said diaphragm which defines said pumping chamber, at the radially outer edge of said convex ridge, is substantially equal to the radius of curvature of said first-mentioned curved surface portion.

9. A fluid pump in accordance with claim 1 wherein the difference between said diameters of said annuli is at least about six times the thickness of said diaphragm in said region where wear occurs.

10. A fluid pump in accordance with claim 1 wherein said housing is formed from a thermoplastic polymer and contains inlet and outlet valve chambers and wherein a flexible unsupported valve member resides in each chamber, said valve member being made of a different thermoplastic polymer than said housing.

11. A fluid pump in accordance with claim 10 wherein said housing is molded from polyphenylene oxide and said valve members are made of polytetrafluoroethylene.

12. A fluid pump comprising a housing having an inlet for fluid, an outlet for fluid and a pumping chamber in communication with said inlet and outlet, inlet valve means, outlet valve means, a flexible diaphragm having an arcuate ridge formed therein which is convex with respect to said pumping chamber, the periphery of said diaphragm being clamped between separable sections of said housing so that one surface of said diaphragm defines part of the boundary of said pumping chamber, a connector extending from the central portion of the opposite surface of said diaphragm, means for attaching said housing to a rotary motor, and drive means for reciprocating said diaphragm to alternately draw fluid into the pumping chamber through said inlet valve means and then discharge the fluid through said outlet valve means, said drive means including an eccentric coupling for connection to the output shaft of the rotary motor plus linkage means joining said eccentric in driving relationship to said connector so that rotation of the motor shaft causes said diaphragm to be driven in a rocking, reciprocating movement, wherein the improvement comprises said diaphragm being clamped at a location within said housing so that it is displaced a substantially greater distance from its unstressed configuration at the completion of the suction stroke than it is at the completion of the discharge stroke.

13. A fluid pump in accordance with claim 12 wherein said greater distance is at least about 50 percent greater.

* * * * *

UNITED STATES PATENT AND TRADEMARK OFFICE

CERTIFICATE OF CORRECTION

PATENT NO. : 4,086,036

DATED : April 25, 1978

INVENTOR(S) : Loren M. Hagen and Ashwin N. Desai

It is certified that error appears in the above–identified patent and that said Letters Patent are hereby corrected as shown below:

Page 1, "Inventors" - Change Ashwin H. Desai to Ashwin N. Desai

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*